US007941088B2

(12) United States Patent
Suzuki

(10) Patent No.: US 7,941,088 B2
(45) Date of Patent: May 10, 2011

(54) IMAGE FORMING APPARATUS

(75) Inventor: Youhei Suzuki, Shizuoka-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/393,216

(22) Filed: Feb. 26, 2009

(65) Prior Publication Data

US 2009/0169224 A1 Jul. 2, 2009

Related U.S. Application Data

(62) Division of application No. 11/398,727, filed on Apr. 6, 2006, now Pat. No. 7,522,874.

(30) Foreign Application Priority Data

Apr. 12, 2005 (JP) ..... 2005-114533

(51) Int. Cl.
*G03G 15/00* (2006.01)

(52) U.S. Cl. ..... 399/405; 399/407

(58) Field of Classification Search ..... 399/405; 347/102

See application file for complete search history.

(56) References Cited

U.S. PATENT DOCUMENTS

| | | | | |
|---|---|---|---|---|
| 5,153,655 | A | 10/1992 | Suzuki et al. | 355/285 |
| 5,157,444 | A | 10/1992 | Mori et al. | 355/282 |
| 5,729,791 | A | 3/1998 | Kutsuwada et al. | 399/82 |
| 5,745,661 | A | 4/1998 | Koh et al. | 395/113 |
| 5,940,543 | A | 8/1999 | Isemura et al. | 382/284 |
| 5,951,005 | A * | 9/1999 | Bartman et al. | 271/188 |
| 6,113,093 | A | 9/2000 | Morinaga et al. | 271/162 |
| 6,190,116 | B1 | 2/2001 | Asada | |
| 6,385,406 | B1 | 5/2002 | Funamizu et al. | 399/16 |
| 6,522,841 | B2 | 2/2003 | Horikoshi | 399/45 |
| 2005/0141939 | A1 * | 6/2005 | Kayama et al. | 399/405 |
| 2005/0286942 | A1 | 12/2005 | Terashima et al. | 399/361 |

FOREIGN PATENT DOCUMENTS

| | | | |
|---|---|---|---|
| JP | 9-204033 | | 8/1997 |
| JP | 11-060024 | A | 3/1999 |
| JP | 2000-95414 | | 4/2000 |
| JP | 2002-229415 | A | 8/2002 |
| JP | 2002-229419 | | 8/2002 |
| JP | 2002229419 | A * | 8/2002 |
| JP | 2003-208043 | | 7/2003 |
| JP | 2004-315229 | | 11/2004 |
| JP | 2006-124104 | | 5/2006 |
| JP | 2006-124105 | | 5/2006 |

* cited by examiner

*Primary Examiner* — Daniel J Colilla
*Assistant Examiner* — Allister Primo
(74) *Attorney, Agent, or Firm* — Fitzpatrick, Cella, Harper & Scinto

(57) ABSTRACT

The image forming apparatus has a discharge device, an air blow device and a detection device, wherein an amount of blown air by the air blow device when the height of the recording materials detected by the detection device is higher than a preset first detection position is smaller than an amount of blown air by the air blow device when the detected height of the recording materials is lower than the first detection position. Thereby, there is provided an image forming apparatus which is improved in the alignment of the recording materials on the stacking portion.

7 Claims, 4 Drawing Sheets

IMAGE FORMING APPARATUS

This application is a divisional application of U.S. patent application No. 11/398,727, filed Apr. 6, 2006, now U.S. Pat. No. 7,522,874.

BACKGROUND OF THE INVENTION

1. Field of the Invention

This invention relates to an image forming apparatus such as a copying machine or a printer adopting an electrophotographic recording method, an electrostatic recording method or the like, and particularly to an image forming apparatus having air blowing means for blowing air to the underside of a recording material discharged by discharging means.

2. Related Background Art

There has heretofore been such an apparatus for cooling a recording material immediately behind a pair of conveyance rollers as described in Japanese Patent Application Laid-open No. 2003-208043 in order to prevent an inconvenience from occurring in the apparatus due to the heat of a recording material heated and fixed by fixing means.

An apparatus of this kind is shown in FIG. 6 of the accompanying drawings. As shown in FIG. 6, a recording material S having reached a high temperature by a toner image thereon being fixed by a fixing device 300 passes between a pair of conveyance rollers 130 and 140 and is discharged onto a sheet discharge tray 150, and design is made such that this recording material S receives air from a fan 200 immediately behind the pair of conveyance rollers 130 and 140.

Thereby, it becomes possible to cool the recording material S, and it is possible to prevent the phenomenon that plastic film sheets such as OHT sheets stick to each other on the sheet discharge tray 150 due to the high temperature thereof, or prevent the temperature of the sheet discharge tray 150 from rising too much to thereby adversely affect the temperature of the interior of an image forming apparatus 500. Further, in a case where the image forming apparatus 500 can form images on the two sides of the recording material S, each one side of the recording material S can be cooled, and the temperature rise in the interior of the image forming apparatus 500 can be prevented to thereby form images of good quality on the recording material S.

Now, if in the above-described apparatus, the shape of the pair of conveyance rollers 130 and 140 is that of through rollers straight and continuous in the longitudinal direction thereof, the waving of the recording material will not occur, but yet correspondingly, the entire recording material may sometimes be rounded on the sheet discharge tray, and in some cases the stackability of the recording material has been deteriorated.

In order to solve this problem, the applicant has proposed in Japanese Patent Application No. 2004-315229 air blowing means set so as to prevent the rounding of a recording material by air from a fan raising and conveying the recording material.

In the proposed apparatus mentioned above, when recording materials are stacked up to near the air outlet of the air blowing means, although within a range substantially free of a problem, the stackability and alignment of the recording materials are somewhat disturbed by the air, and a further improvement has been desired from the viewpoint of an apparatus which is better in the handling of the recording materials.

SUMMARY OF THE INVENTION

An object of the present invention is to provide an image forming apparatus which is improved in the alignment of recording materials on a stacking portion.

Another object of the present invention is to provide an image forming apparatus having a discharge device for discharging a recording material having images formed thereon to a stacking portion, an air blow device for blowing air to the underside of the recording material discharged by the discharge device, the air blow device blowing the air substantially in the movement direction of the recording materials discharged by the discharge device, and a detection device for detecting the height of the recording materials stacked on the stacking portion, wherein an amount of blown air by the air blow device when the height of the recording materials detected by the detection device is higher than a preset first detection position is smaller than an amount of blown air by the air blow device when the aforementioned detected height of the recording materials is lower than the first detection position.

A further object of the present invention is to provide an image forming apparatus having a discharge device for discharging a recording material having images formed thereon to a stacking portion, an air blow device for blowing air to the underside of the recording material discharged by the discharge device, the air blow device blowing the air substantially in the movement direction of the recording material discharged by the discharge device, and a detection device for detecting the height of the recording material stacked on the stacking portion, wherein the air blow device is stopped when the height of the recording materials detected by the detection device reaches a preset first detection position.

A further object of the present invention is to provide an image forming apparatus having a discharge device for discharging a recording material having images formed thereon to a stacking portion, an air blow device for blowing air to the underside of the recording material discharged by said discharge device, and a detection device for detecting a height of recording materials stacked on said stacking portion, wherein when the height of the recording materials detected by said detection device is lower than a preset first detection position, said air blow device blows the air in a first amount of blown air, and when the detected height of the recording materials is between said first detection position and a preset second detection position higher than said first detection position, said air blow device blows the air in a second amount of blown air smaller than said first amount of blown air, and when the detected height of the recording materials has reached said second detection position, said air blow device is stopped.

A further object of the present invention is to provide an image forming apparatus having a discharge device for discharging a recording material having images formed thereon to a stacking portion, an air blow device for blowing air to the underside of the recording material discharged by said discharge device; and a detection device for detecting a height of recording materials stacked on said stacking portion, wherein when the height of the recording materials detected by said detection device is lower than a preset first detection position, said air blow device blows the air, and when the detected height of the recording materials is between said first detection position and a preset second detection position higher than said first detection position, said air blow device is stopped and an image forming operation is performed, and when the detected height of the recording materials has reached said second detection position, the image forming operation is stopped.

A still further object of the present invention will become apparent from the following description and the accompanied drawings.

DESCRIPTION OF THE PREFERRED EMBODIMENTS

Some embodiments of the present invention will hereinafter be described with reference to the drawings.

First Embodiment

Figure 1:
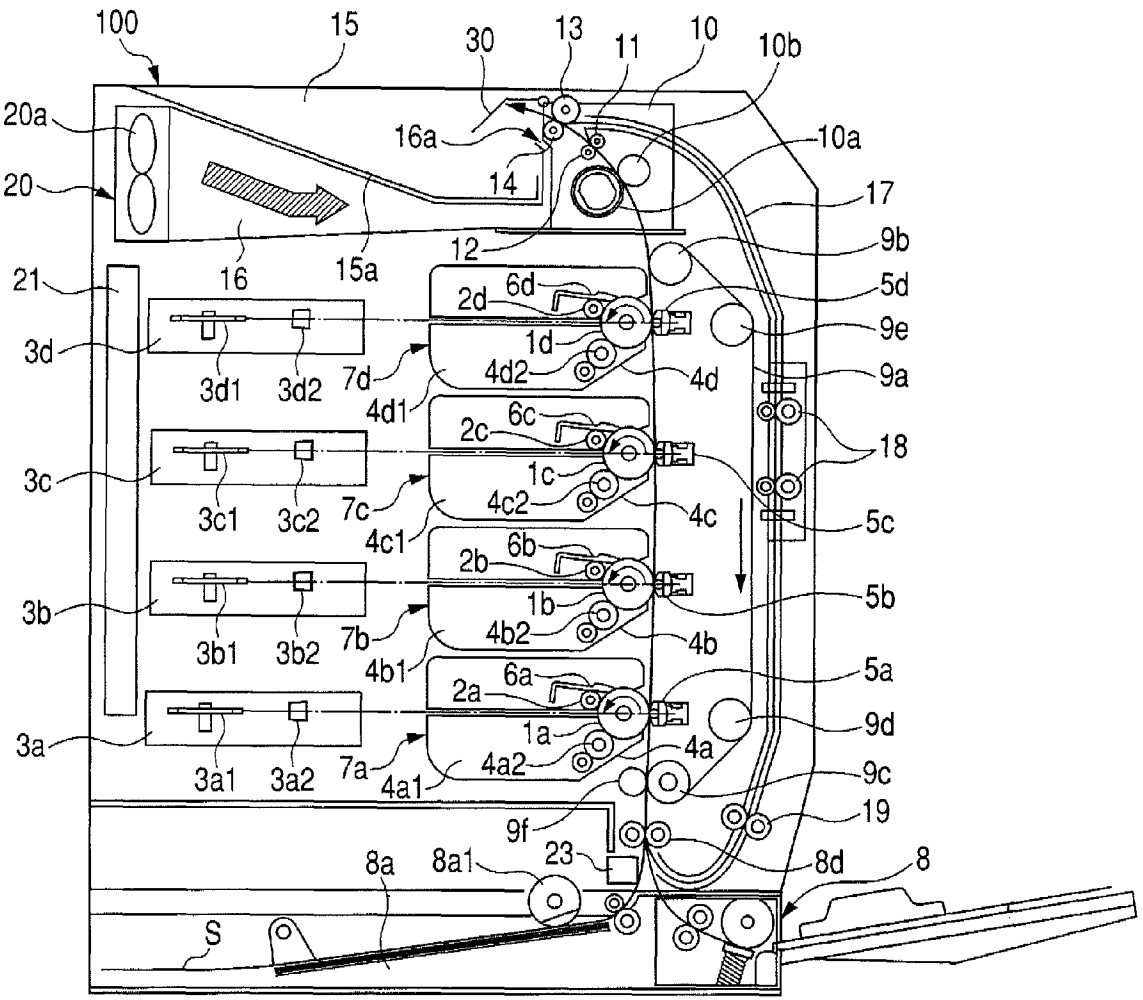
FIG. 1 shows an image forming apparatus which is an embodiment of the present invention.

Reference is first had to FIG. 1 to describe the general construction of an image forming apparatus which is a first embodiment of the present invention. In the present embodiment, the image forming apparatus is a full-color laser beam printer which can form a full-color image on a recording material such as, for example, plain paper or an OHT sheet by an electrophotographic printing method in conformity with an image information signal from an external host device such as a personal computer connected to an apparatus main body for communication therewith. The present invention, however, is not restricted thereto, but can be embodied in an arbitrary form such as a copying machine or a facsimile apparatus.

The image forming apparatus 100 shown in FIG. 1 is provided with four drum-shaped image bearing members, i.e., photosensitive drums 1*a*, 1*b*, 1*c* and 1*d* juxtaposed in a substantially vertical direction, as image bearing members. The photosensitive drums 1*a* to 1*d* are rotatively driven in a counter-clockwise direction as viewed in FIG. 1 by driving means, not shown. Around the respective photosensitive drums 1*a* to 1*d*, there are disposed, in succession in accordance with the rotation direction thereof, charging devices 2*a*, 2*b*, 2*c*, 2*d* for uniformly charging the surfaces of the photosensitive drums 1*a* to 1*d*, scanner units 3*a*, 3*b*, 3*c*, 3*d* for applying a laser beam on the basis of image information to thereby form electrostatic latent images on the photosensitive drums 1*a* to 1*d*, developing devices 4*a*, 4*b*, 4*c*, 4*d* for causing toners provided in developers to adhere to the electrostatic latent images to thereby develop the latent images as toner images, transfer devices 5*a*, 5*b*, 5*c*, 5*d* for transferring the toner images on the photosensitive drums 1*a* to 1*d* to a recording material S, and cleaning devices 6*a*, 6*b*, 6*c*, 6*d* for removing any untransferred toners residual on the surfaces of the photosensitive drums 1*a* to 1*d* after the transfer.

In the present embodiment, images of different colors (yellow, cyan, magenta and black) are formed by four image forming portions which are image forming means provided with the photosensitive drums 1*a* to 1*d*, the charging devices 2*a* to 2*d*, the scanner units 3*a* to 3*d*, the developing devices 4*a* to 4*d* and the cleaning devices 6*a* to 6*d*.

The photosensitive drums 1*a* to 1*d*, and the charging devices 2*a* to 2*d*, the developing devices 4*a* to 4*d* and the cleaning devices 6*a* to 6*d* as process means for acting on the photosensitive drums 1*a* to 1*d* are integrally made into cartridges to thereby form process cartridges 7*a*, 7*b*, 7*c* and 7*d* detachably mountable on the apparatus main body 100.

In the following description, the front side of the image forming apparatus 100 refers to a side on which the process cartridges 7*a* to 7*d* are inserted into the apparatus main body 100, i.e., the right side as viewed in FIG. 1. Also, the left and right of the image forming apparatus 100 are those when the apparatus 100 is viewed from the front side thereof. Each element will hereinafter be described in greater detail in succession from the photosensitive drums 1*a* to 1*d*.

Each of the photosensitive drums 1*a* to 1*d* is an organic photoconductive member (OPC photosensitive member comprising, for example, an aluminum cylinder having a diameter of 30 mm, and an organic photoconductor substance applied to the outer peripheral surface thereof to thereby form an organic photoconductor layer. Each of the photosensitive drums 1*a* to 1*d* has its opposite end portions rotatably supported by supporting members, and a driving force from a drive motor, not shown, is transmitted to one end portion, whereby each photosensitive drum is rotatively driven in a counter-clockwise direction as viewed in FIG. 1.

As the charging devices 2*a* to 2*d*, use can be made of charging members of a contact charging type. The charging members are electrically conductive rollers formed into a roller shape, and these rollers are brought into contact with the surfaces of the photosensitive drums 1*a* to 1*d* and also, a charging bias voltage is applied to these rollers to thereby uniformly charge the surfaces of the photosensitive drums 1*a* to 1*d*.

The scanner units 3*a* to 3*d* are disposed in the substantially horizontal direction of the photosensitive drums 1*a* to 1*d*, and by a laser diode, not shown, image light corresponding to an image signal is applied to polygon mirrors 3*a*1, 3*b*1, 3*c*1 and 3*d*1 rotated at a high speed by a scanner motor, not shown. The image light reflected by the polygon mirrors 3*a*1 to 3*d*1 selectively exposes the charged surfaces of the photosensitive drums 1*a* to 1*d* through imaging lenses 3*a*2, 3*b*2, 3*c*2 and 3*d*2 thereto, whereby electrostatic latent images are formed on the photosensitive drums.

The developing devices 4*a* to 4*d* have toner containers 4*a*1, 4*b*1, 4*c*1 and 4*d*1 containing therein toners of respective colors, i.e., yellow, cyan, magenta and black, as developers, and feed the toners in the toner containers 4*a*1 to 4*d*1 to developing rollers 4*a*2, 4*b*2, 4*c*2 and 4*d*2 by a toner conveying mechanism, not shown. The toners are applied to the outer peripheries of the developing rollers 4*a*2 to 4*d*2 rotated in a clockwise direction as viewed in FIG. 1, and charges are imparted to the toners. Then, a developing bias usually comprising an AC voltage and a DC voltage superimposed one upon the other is applied to the developing rollers 4*a*2 to 4*d*2 opposed to the photosensitive drums 1*a* to 1*d* on which the latent images have been formed, whereby the toners are supplied onto the photosensitive drums 1*a* to 1*d* in conformity with the latent images.

An electrostatic transfer belt 9*a* circularly moved as a recording material conveying member is disposed in opposed relationship with the photosensitive drums 1*a* to 1*d* so as to contact with all of these drums. The transfer belt 9*a* is comprised of a film-like member having volume resistivity of $10^{11}$-$10^{14}$ Ω·cm and having a thickness of about 150 μm. This transfer belt 9*a* is supported on rollers in a vertical direction by four shafts, and is circularly moved so as to electrostatically attract the recording material S to the left outer peripheral surface thereof as viewed in FIG. 1 to thereby bring the recording material S into contact with the photosensitive drums 1*a* to 1*d*. Thereby, the recording material S is conveyed to a transferring position by the transfer belt 9*a*, and the toner images on the photosensitive drums 1*a* to 1*d* are transferred to the recording material S.

Transfer rollers 5*a* to 5*d* are juxtaposed at positions (transferring positions) in contact with the inner side of this transfer belt 9*a* and opposed to respective ones of the four photosensitive drums 1*a* to 1*d*. Charges of a positive polarity are applied from these transfer rollers 5*a* to 5*d* to the recording material S through the transfer belt 9*a*, and by an electric field by these charges, the toner images of a negative polarity on the photosensitive drums 1*a* to 1*d* are transferred to the recording material S being in contact with the photosensitive drums 1*a* to 1*d*. The transfer belt 9*a* is also an image conveying member bearing and conveying thereon the recording material S to which the toner images formed on the photosensitive drums 1*a* to 1*d* are transferred.

In the present embodiment, the transfer belt 9*a* is a belt having a circumferential length of 675 mm and a thickness of 120 μm, and is passed over four rollers, i.e., a driving roller 9*b*, driven rollers 9*c*, 9*d* and a tension roller 9*e*, and the driving roller 9*b* is rotatively driven by a drive motor, not shown, which is image conveying member driving means, whereby the transfer belt is rotated in the direction of arrow in FIG. 1. During the time when the transfer belt 9*a* is circularly moved and the recording material S is conveyed from the driven roller 9*c* side to the driving roller 9*b* side, the toner images are transferred to the recording material S.

A sheet supplying portion 8 serves to supply and convey the recording material S to the image forming portion, and a plurality of recording materials S are contained in a sheet supplying cassette 8*a*. During image formation, a sheet feeding roller (half moon roller) 8*a*1 and a pair of registration rollers 8*d* are rotatively driven in conformity with an image forming operation to thereby separate and feed the recording materials S in the sheet supplying cassette 8*a* one by one, and the leading edge of the recording material S thus fed strikes against the pair of registration rollers 8*d* and is once stopped to thereby form a loop, and thereafter the recording material S is fed to the transfer belt 9*a* by the air of registration rollers 8*d* in synchronism with the rotation of the transfer belt 9*a* and an image writing start position.

A fixing portion 10 serves to fix the toner images of plural colors transferred to the recording material S, and comprises a rotatable heating roller 10*a* and a pressure roller 10*b* brought into pressure contact therewith to thereby give heat and pressure to the recording material S. That is, the recording material S to which the toner images on the photosensitive drums 1*a* to 1*d* have been transferred is conveyed by the pair of fixing rollers 10*a* and 10*b*, and is given the heat and pressure by the pair of fixing rollers 10*a* and 10*b* when it passes through the fixing portion 10. Thereby, the toner images of the plural colors are fixed on the surface of the recording material S.

Description will now be made of the operation of the image forming apparatus 100 of the above-described construction. The process cartridges 7*a* to 7*d* are successively driven in accordance with image formation timing, and in conformity with the driving thereof, the photosensitive drums 1*a* to 1*d* are rotatively driven in the counter-clockwise direction as viewed in FIG. 1. Then, the scanner units 3*a* to 3*d* corresponding to the respective process cartridges 7*a* to 7*d* are successively driven. By this driving, the charging rollers 2*a* to 2*d* impart uniform charges to the peripheral surfaces of the photosensitive drums 1*a* to 1*d*, and the scanner units 3*a* to 3*d* effect exposure conforming to the image signal on the peripheral surface of the photosensitive drums 1*a* to 1*d*, whereby electrostatic latent images are formed on the peripheral surfaces of the photosensitive drums 1*a* to 1*d*. The developing rollers 4*a*2 to 4*d*2 in the developing devices 4*a* to 4*d* shift the toners to the low potential parts of the electrostatic latent images to thereby form (develop) toner images on the peripheral surfaces of the photosensitive drums 1*a* to 1*d*. At the timing whereat the leading edge of the toner image formed on the peripheral surface of the most upstream photosensitive drum 1*a* with respect to the recording material conveying direction is rotatively conveyed to an opposed point (transferring position) to the transfer belt 9*a*, the pair of registration rollers 8*d* start to rotate so that the image formation starting position of the recording material S may coincide with the opposed point, thus feeding the recording material S to the transfer belt 9*a*.

The recording material S comes into pressure contact with the outer peripheral surface of the transfer belt 9*a* in such a manner as to be nipped by and between an electrostatic attracting roller 9*f* and the transfer belt 9*a*. Also, a voltage is applied to between the transfer belt 9*a* and the electrostatic attracting roller 9*f*, whereby charges are induced in the recording material S which is a dielectric material and the dielectric material layer of the transfer belt 9*a*, and the recording material S is stably attracted to the transfer belt 9*a*, and is conveyed to the most downstream transferring position. The recording material S is thus conveyed by the transfer belt 9*a* and at the same time, the toner images on the photosensitive drums 1*a* to 1*d* are successively transferred to the recording material S by electric fields formed between the photosensitive drums 1*a* to 1*d* and the transfer rollers 5*a* to 5*d*. The recording material S to which the toner images of the four colors have been transferred is curvature-separated from the transfer belt 9*a* by the curvature of the driving roller 9*b*, and is conveyed into the fixing portion 10. The recording material S has the toner images thereon heat-fixed by the fixing portion 10, and thereafter is discharged to a sheet discharge part (stacking portion) 15 outside the apparatus main body 100 with its image surface facing down by a pair of sheet discharging rollers (conveying rollers) 13 and 14 which form a discharge device. Also, in case of two-side printing, the recording material S is fixed by the fixing portion 10 and is conveyed to a two-side conveying route 17 by the pair of sheet discharging rollers 13 and 14 being reversely rotated before it is completely discharged by the pair of sheet discharging rollers 13 and 14. The recording material S thus conveyed to the two-side conveying route 17 passes skew feeding rollers 18 at the front of the apparatus main body, is vertically downwardly conveyed to U-turn rollers 18, and is again conveyed to the image forming portion by the U-turn rollers and the pair of registration rollers 8*d*.

Also, as shown in FIG. 1, a pair of conveyance rollers 11 and 12 and a pair of sheet discharging rollers 13 and 14 are provided on the downstream side with respect to the conveying direction of the recording material S subjected to the fixing action by the heating member 10*a* and the pressure member 10*b*. The pair of conveyance rollers 11 and 12 and the pair of sheet discharging rollers 13 and 14 are pairs of straight-shaped through rollers adapted to contact with substantially the full width of the image area of the recording material S in order to prevent image faults such as the roller trace to the image and the waving of the OHT sheet. If one of this pair of rollers is a straight-shaped through roller contacting with substantially the full width of the image area of the recording material, the roller trace and the waving or the like can be mitigated.

An air blow device 20 has its amount of blown air controlled by controlling means 21. An air outlet (air blowout portion) 16*a* from which the air blown from the air blow device 20 is blown out is disposed below the pair of sheet discharging rollers 13 and 14, namely, blow a discharge port 25, and serves to blow the air to the underside of the recording material S discharged to the sheet discharge part 15 in a direction indicated by arrow A (see FIG. 2). That is, the air blow device 20 has a fan 20*a*, a duct 16 and an air outlet 16*a*, and the air from the fan 20*a* passes through the duct 16 to the air outlet 16*a*, and by the air A from this air outlet 16*a*, the air is blown substantially in the movement direction of the recording material discharged by the pair of sheet discharging rollers 13 and 14.

Figure 2:
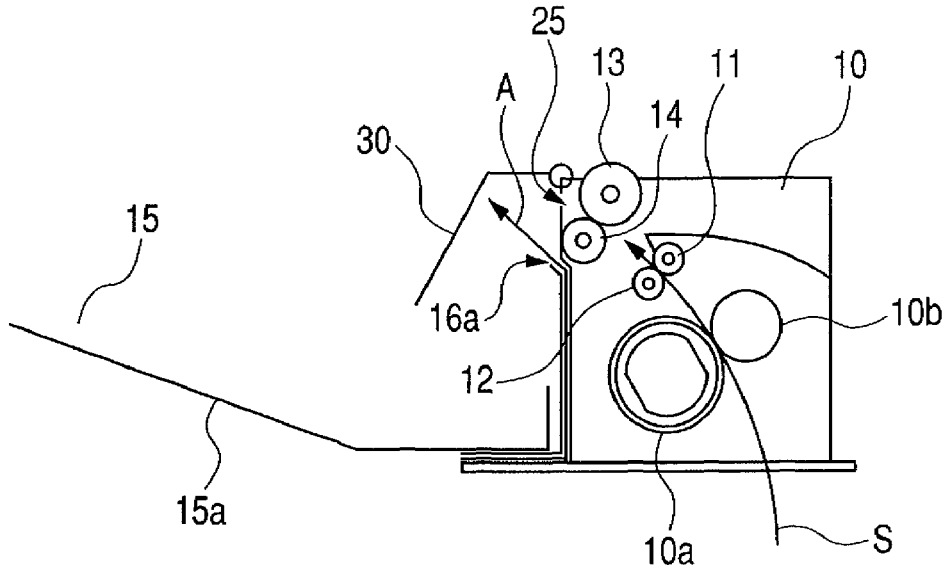
FIG. 2 shows the surrounding portions of the sheet discharge part of the image forming apparatus.

Description will first be made here of the initial state when the recording materials are continuously discharged to and stacked on a sheet discharge tray 15*a* which is the recording material supporting member of the sheet discharge part. As shown in FIG. 2, when the recording material is to be discharged, the fan 20*a* of the air blow device 20 starts to rotate before the leading edge of the recording material arrives at the pair of sheet discharging rollers 13 and 14, and applies a predetermined amount of or more air (a first amount of blown air) A to the underside of the leading edge of the conveyed recording material. The recording material is conveyed to the sheet discharge part 15 by the pair of sheet discharging rollers 13 and 14 while the leading edge thereof is raised upwardly, whereafter the trailing edge of the recording material which has passed the pair of sheet discharging rollers 13 and 14 falls onto the sheet discharge tray 15*a* from gravity.

Even if as described above, in the early state of sheet discharge, the fall distance of the recording material from the discharge portion (discharge port) of the discharge device to the sheet discharge tray 15*a* is relatively long, the leading edge of the recording material is raised by the wind A and therefore, the recording material is stacked on the sheet discharge tray 15*a* without being rounded.

Figure 3:
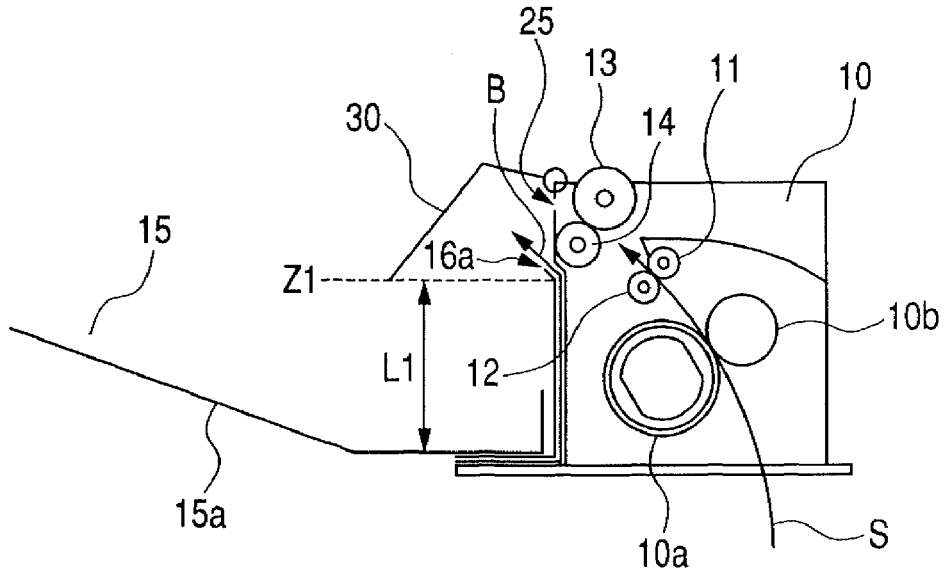
FIG. 3 shows a state in which recording materials are stacked up to a first detection position.

The control of the air blow device when the recording materials S in the present embodiment are stacked up to this side before they arrive at the air outlet 16*a* will now be described with reference to FIG. 3.

On the sheet discharge part 15, there is disposed a detecting member 30 (stacked state detecting member) as a detection device which can detect the height of the recording materials stacked on the sheet discharge part 15. As shown in FIG. 3, the recording materials S are stacked on the sheet discharge part 15 and reach a preset predetermined position Z1 (first detection position: the position of a distance L1 from the sheet discharge tray 15*a*), whereupon the detecting member 30 detects it, and on the basis of the result of the detection, the air blow device 20 changes over the amount of blown air from the air outlet from the first amount of blown air A to a second amount of blown air B smaller than the first amount of blown air.

That is, in the present embodiment, the amount of blown air (second amount of blown air) by the air blow device when the height of the recording materials detected by the detection device is higher than the preset first detection position is smaller than the amount of blown air (first amount of blown air) by the air blow device when the aforementioned height is lower than the first detection position.

In the present embodiment, the first amount of blown air is 0.7 $m^3$/min. to 1.2 $m^3$/min., and the second amount of blown air is 0.3 $m^3$/min., and the first detection position is a position lower by 2 mm than the air outlet 16*a* of the air blow device 20.

Figure 4:
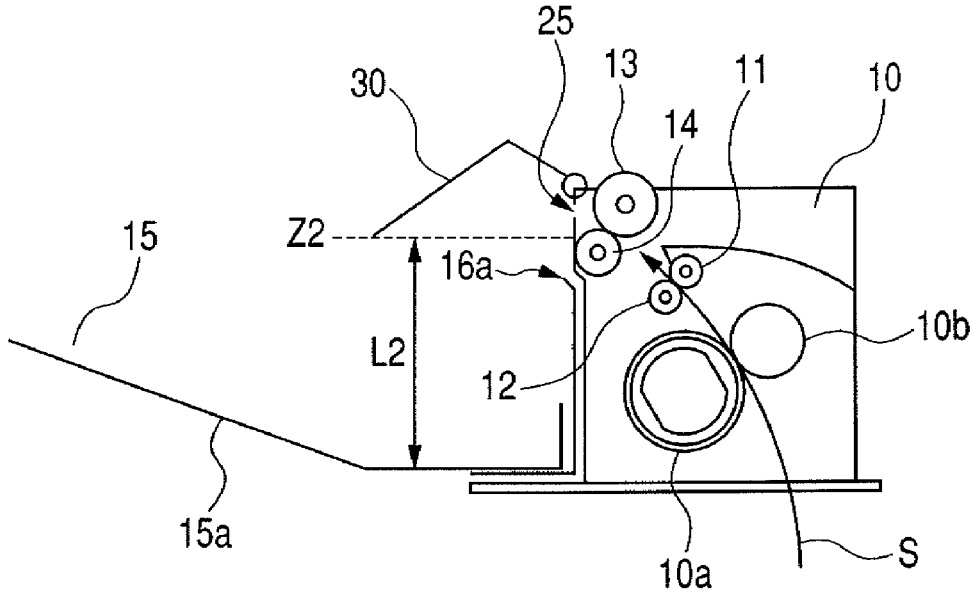
FIG. 4 shows a state in which the recording materials are stacked up to a second detection position.

Next, as shown in FIG. 4, the recording materials S are further stacked on the sheet discharge part 15 and reach a preset predetermined position Z2 (second detection position: the position of a distance L2 from the sheet discharge tray 15*a*, L2 being greater than L1), whereupon the detecting member 30 detects it, and the apparatus main body 100 recognizes that the sheet discharge part has been fully loaded with the stacked recording materials S, and stops the conveyance of the recording material S and the air blow by the air blowing means (stops the image forming operation).

That is, when the height of the recording materials detected by the detection device is lower than the first detection position, the air blow device blows the air in the first amount of blown air, and the height of the recording materials is between the first detection position and the second detection position, the air blow device blows the air in the second amount of blown air smaller than the first amount of blown air, and when the height of the recording materials reaches the second detection position, the air blow device is stopped.

In the present embodiment, the second detection position L2 is higher by 3 mm than the air outlet 16*a*, and when the recording materials are stacked up to here, the stacked recording materials close the air outlet 16*a*. As a matter of course, the second detection position is lower in height than the discharge port 25.

As described above, in the present embodiment, at a point of time whereat the recording materials stacked on the sheet discharge part have come close to the air outlet, the amount of blown air from the air outlet is made smaller than before, but when the recording materials have come close to the air outlet, the fall distance of the next discharged recording material from the discharge port 25 is relatively short and the leading edge side of the recording material falls before it is rounded and therefore, even if the amount of blown air is small, the stackability of the recording material is not affected. Also, the trailing edge of the recording material becomes close to the air outlet, but the amount of blown air is small and therefore, the alignment of the stacked recording materials is not affected. As the result, in the present embodiment, the recording materials can also be stacked above the air outlet, and the number of stacked recording materials can be increased. Also, although somewhat, the air is blowing out from the air outlet and therefore, the heat of the sheet discharge part can be moved.

The above-mentioned values are changeable by the position and shape of the air outlet, the position and construction of the pair of conveying rollers, etc., and are not restrictive.

Second Embodiment

A second embodiment of the present invention will now be described. The basic construction of the second embodiment is similar to that of the first embodiment, and the different portions thereof will hereinafter be described.

Figure 5:
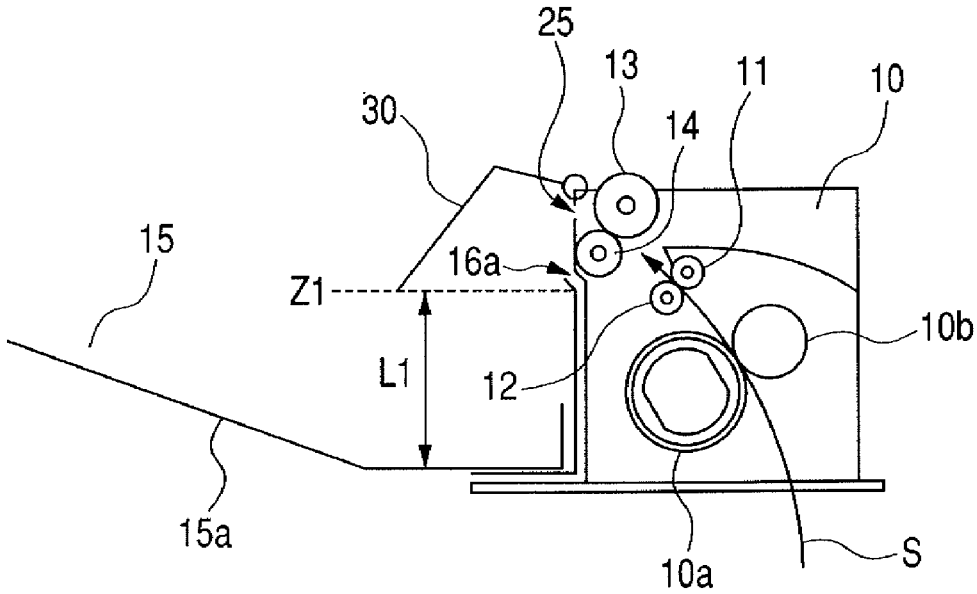
FIG. 5 shows the surrounding portions of the sheet discharge part of an image forming apparatus which is another embodiment of the present invention.
Figure 6:
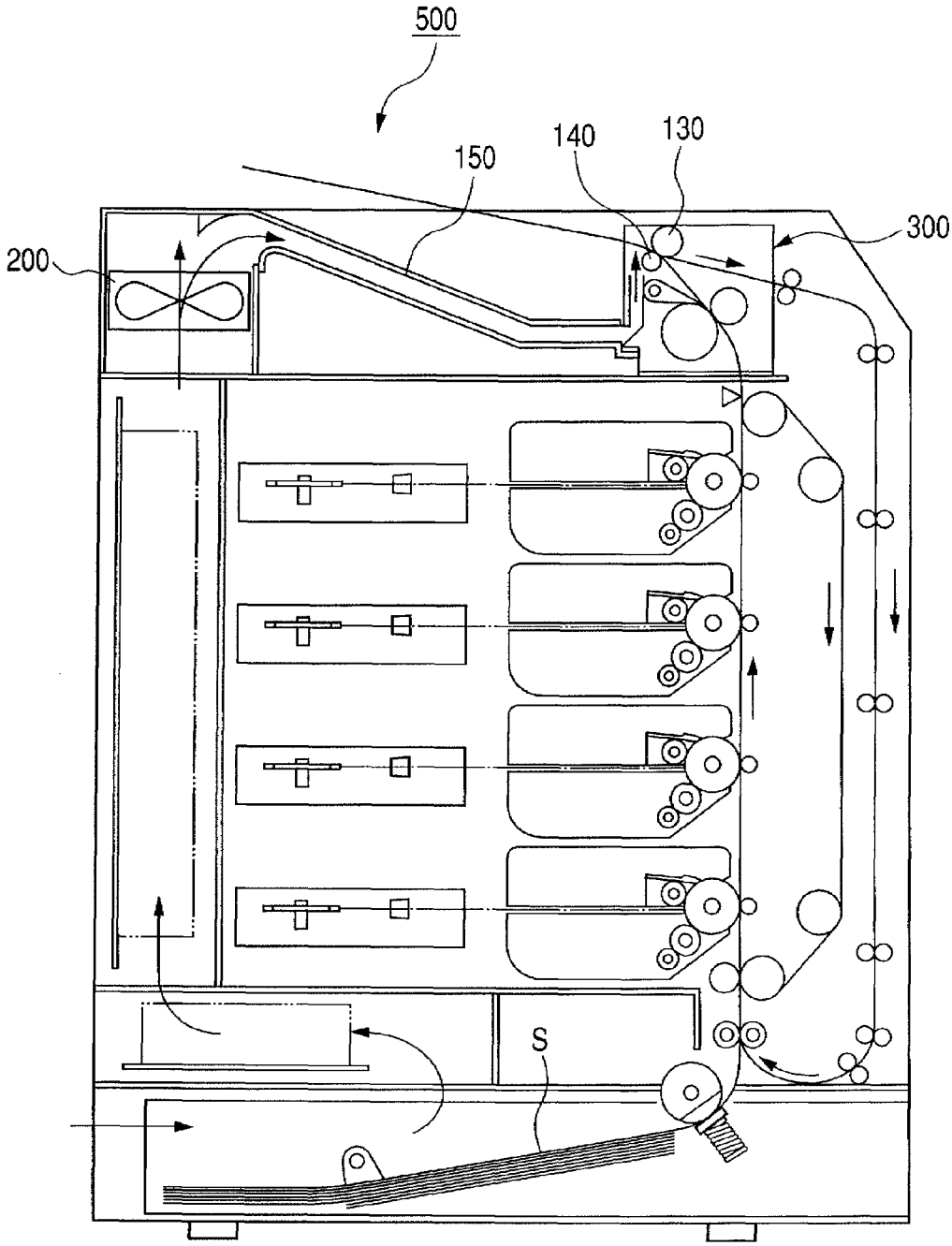
FIG. 6 shows a conventional image forming apparatus.

Depending on the discharge speed or the like of the recording material, the sheet discharge part does not have much heat and therefore, in the present embodiment, when as shown in FIG. 5, the recording materials S are stacked up to this side before they reach the air outlet 16*a*, the air blowing means is stopped.

That is, in the present embodiment, when the height of the recording materials detected by the detection device has reached a preset predetermined position (first detection position) the air blow device is stopped, and the amount of blown air is zero.

As shown in FIG. 5, in the present embodiment, the recording materials S are stacked on the sheet discharge part 15 and reach a preset predetermined position Z1 (first detection position: the position of the distance L1 from the sheet discharge tray 15*a*), whereupon the detecting member 30 detects it, and on the basis of the result of the detection, the air blowing means 20 stops air blow from the air outlet. The detection of the full load thereafter is similar to that in FIG. 4.

That is, when the height of the recording materials detected by the detection device is lower than the first detection position, the air blow device blows the air, and when the height of the recording materials is between the first detection position and the second detection position, the air blow device is stopped and the image forming operation is performed, and when the height of the recording materials has reached the second detection position, the image forming operation is stopped.

As described above, in the present embodiment, at a point of time whereat the recording materials stacked on the sheet discharge part have come close to the air outlet, the air blow from the air outlet is stopped and therefore, the alignment of the trailing edges of the recording materials can be more improved.

Third Embodiment

A third embodiment of the present invention will now be described. The basic construction of the third embodiment is similar to that of the first embodiment, and the different portions thereof will hereinafter be described.

While in the first embodiment, the detection of a full load the recording material is the time when the detecting member has reached the second detection position and it has been detected, in the present embodiment, when the stacked amount of the recording materials has reached the first detection position, whereafter a preset member of recording materials have been discharged, the apparatus main body 100 recognizes that the sheet discharge part has been fully loaded with the stacked recording materials, and stops the conveyance of the recording material and the air blow by the air blowing means.

Also, in the present embodiment, it is possible to detect the kind of the recording material by recording material detecting means 23, and it is possible to set the aforementioned predetermined number of recording materials to a different value in conformity with the kind of the recording material.

That is, in the present embodiment, control is effected such that in the case of thin paper or plain paper, the point of time at which 50 sheets have been discharged from the first detection position L1 is recognized as the sheet discharge part having been fully loaded with the recording materials S, and in the case of plastic film such as an OHT sheet or thick paper, the point of time at which 30 sheets have been discharged from the first detection position L1 is recognized as the sheet discharge part having been fully loaded with the recording materials S, and the conveyance of the recording material S and the air blow by the air blowing means are stopped.

Thereby, in the present embodiment, the effect described in the first embodiment can be achieved and also, the control construction by the detecting member can be simplified.

Fourth Embodiment

A fourth embodiment of the present invention will now be described. The basic construction of the fourth embodiment is similar to that of the second embodiment, and the different portions thereof will hereinafter be described.

While in the second embodiment, the detection of a full load of recording materials is regarded as the time when the detecting member has reached the second detection position and this has been detected, in the present embodiment, when a preset predetermined number of recording materials have been discharged after the amount of stacked recording materials has reached the first detection position, the apparatus main body 100 recognizes that the sheet discharge part has been fully loaded with the stacked recording materials, and the conveyance of the recording material is stopped and the image forming operation is stopped.

Also, in the present embodiment, it is possible to detect the kind of the recording material by the recording material detecting means 23, and it is possible to set the aforementioned predetermined number of recording materials to a different value in conformity with the kind of the recording material.

That is, in the present embodiment, control is effected such that in the case of thin paper or plain paper, the point of time at which 50 sheets have been discharged from the first detection position L1 is recognized as the sheet discharge part having been fully loaded with the recording materials S, and in the case of plastic film such as an OHT sheet or thick paper, the point of time at which 30 sheets have been discharged from the first detection position L1 is recognized as the sheet discharge part having been fully loaded with the recording materials S, and the conveyance of the recording material S is stopped and the image forming operation is stopped.

Thereby, in the present embodiment, the effect described in the second embodiment can be achieved and also, the control construction by the detecting member can be simplified.

As described above, in the first to fourth embodiments, the air blow device is controlled and therefore, even if the recording materials are stacked up to near the air outlet of the air blow device, the stackability and alignment of the recording materials are not disturbed by the air, and it is possible to solve the problem that the sheet discharge part must be fully loaded and the conveyance of the recording material must be stopped before the recording materials close the air outlet. As the result, in the present embodiment, the number of stacked sheets can be increased.

As described above, according to the present invention, even when a number of recording materials have been stacked on the stacking portion, the stackability and alignment of the recording materials can be improved.

While the embodiments of the present invention have been described above, the present invention is restricted in no way to the above-described embodiments, but all modifications are possible within the technical idea of the present invention.

This application claims priority from Japanese Patent Application No. 2005-114533 filed on Apr. 12, 2005, which is hereby incorporated by reference herein.

What is claimed is:

1. An image forming apparatus comprising:

a discharge device that discharges a recording material having images formed thereon to a stacking portion;

an air blow device that blows air to an underside of the recording material discharged by the discharge device, the air blow device blowing the air substantially in a discharge direction of the recording material discharged by the discharge device; and a detection device that detects a height of recording materials stacked on the stacking portion, wherein the detection device detects the height of recording materials at a first preset detection position and a second preset detection position, the second preset detection position being higher than the first preset detection position, wherein the air blow device is stopped when the height of recording materials detected by the detection device has reached the first preset detection position, wherein an image forming operation continues to be performed after the air blow device has been stopped when the height of recording materials detected by the detection device reaches the first preset detection position, and wherein the image forming operation stops when the height of recording materials detected by the detection device reaches the second preset detection position.

2. An image forming apparatus according to claim 1, wherein the first preset detection position is lower in height than an air blowout portion of the air blow device which blows out the air.

3. An image forming apparatus according to claim 2, wherein the second preset detection position is higher in height than the air blowout portion of the air blow device which blows out the air.

4. An image forming apparatus comprising:

a discharge device that discharges a recording material having images formed thereon to a stacking portion;

an air blow device that blows air to an underside of the recording material discharged by the discharge device, the air blow device blowing the air substantially in a discharge direction of the recording material discharged by the discharge device; and a detection device that detects a height of recording materials stacked on the stacking portion at a preset detection position, wherein the air blow device stops when the height of recording materials detected by the detection device reaches the preset detection position, and wherein an image forming operation continues to be performed after the air blow device has been stopped when the height of recording materials detected by the detection device reaches the preset detection portion, and the image forming operation is stopped when a predetermined number of recording materials have been discharged by the discharge device, after the height of recording materials detected by the detection device reaches the preset detection position.

5. An image forming apparatus according to claim 4, wherein the predetermined number of recording materials differs depending on a kind of the recording material.

6. An image forming apparatus according to claim 1, wherein, independently of a type of recording material discharged from the discharge device, the air blow device stops when the height of recording materials detected by the detection device reaches the first preset detection position, and the image forming operation continues to be performed after the air blow device has been stopped when the height of recording materials detected by the detection device reaches the first preset detection position, and the image forming operation is stopped when the height of recording materials detected by the detection device reaches the second preset detection position.

7. An image forming apparatus according to claim 4, wherein, independently of a type of recording material discharged from the discharge device, the air blow device stops when the height of recording materials detected by the detection device reaches the preset detection position, and the image forming operation continues to be performed after the air blow device has been stopped when the height of recording materials detected by the detection device reaches the preset detection portion, and the image forming operation is stopped when a predetermined number of recording materials have been discharged by the discharge device, after the height of recording materials detected by the detection device reaches the preset detection position.

* * * * *